US007571557B2

(12) United States Patent
Charbonneau

(10) Patent No.: US 7,571,557 B2
(45) Date of Patent: Aug. 11, 2009

(54) ICE-REMOVING DEVICE

(76) Inventor: Guy Charbonneau, 750 Bethanie Avenue, Lachute, QC (CA) J8H 2C5

( * ) Notice: Subject to any disclaimer, the term of this patent is extended or adjusted under 35 U.S.C. 154(b) by 0 days.

(21) Appl. No.: 11/832,899

(22) Filed: Aug. 2, 2007

(65) Prior Publication Data

US 2008/0030064 A1 Feb. 7, 2008

Related U.S. Application Data

(60) Provisional application No. 60/835,973, filed on Aug. 7, 2006.

(51) Int. Cl.
*E01H 4/00* (2006.01)
*E01H 5/09* (2006.01)

(52) U.S. Cl. ..... 37/222; 37/221; 37/223; 299/24

(58) Field of Classification Search ..... 299/24, 299/25, 28; 37/219–223
See application file for complete search history.

(56) References Cited

U.S. PATENT DOCUMENTS

| | | | | | |
|---|---|---|---|---|---|
| 2,424,460 | A | * | 7/1947 | Hettelsater | 37/189 |
| 2,606,011 | A | | 8/1952 | Lommen | |
| 2,732,573 | A | | 1/1956 | Hyland | |
| 2,789,804 | A | * | 4/1957 | Toulmin, Jr. | 299/17 |
| 3,094,315 | A | | 6/1963 | Yetter | |
| 3,964,183 | A | | 6/1976 | Mouat | |
| 4,186,967 | A | * | 2/1980 | Kuhmonen | 299/25 |
| 4,340,118 | A | | 7/1982 | van der Lely | |
| 4,520,582 | A | * | 6/1985 | Niemela | 37/222 |
| 5,533,790 | A | * | 7/1996 | Weiland | 299/1.5 |
| 5,540,004 | A | | 7/1996 | Patterson et al. | |
| 5,607,205 | A | * | 3/1997 | Burdick et al. | 299/1.5 |
| 5,795,096 | A | | 8/1998 | Culver | |
| 6,260,293 | B1 | | 7/2001 | Monroe | |
| 6,560,905 | B2 | | 5/2003 | Monroe | |
| 6,634,719 | B1 | | 10/2003 | Monroe | |
| 2006/0226695 | A1 | * | 10/2006 | Pirila | 299/1.5 |

FOREIGN PATENT DOCUMENTS

| | | |
|---|---|---|
| FR | 1041107 | 10/1953 |
| GB | 773163 | 4/1957 |

* cited by examiner

*Primary Examiner*—Sunil Singh
(74) *Attorney, Agent, or Firm*—Bereskin & Parr

(57) ABSTRACT

An ice-removing device for removing ice from a ground surface. The ice-removing device comprises a frame and an ice cutting mechanism. The ice cutting mechanism is attached to the frame and is adapted to spin on a first axis oriented transversally to the frame. The ice cutting mechanism is operative to cut a plurality of parallel strips in the ice. Optionally, the ice-removing device further comprises at least one ice crushing mechanism, which is also attached to the frame, behind the ice crushing mechanism. The ice crushing mechanism is adapted to spin on a second axis that is non-parallel to the first axis. Both the ice cutting mechanism and the ice crushing mechanism are operationally positioned to contact the ice. In another embodiment the ice-removing device is adapted to be mounted to a mobile support.

26 Claims, 6 Drawing Sheets

ICE-REMOVING DEVICE

FIELD OF THE INVENTION

The present invention relates to the field of ground surface de-icing. More particularly, the invention relates to a device for removing ice from iced ground surfaces such as roads and runways.

BACKGROUND OF THE INVENTION

Keeping ground surfaces, particularly roads and airport runways, free of ice has long been a major problem in geographical regions where temperatures drop below freezing. Over the years, many methods and apparatus have been developed and constructed to clear such ground surfaces of ice.

Some methods of clearing ground surfaces of ice include scarifying the ice, that is, cutting grooves into the ice to increase the surface area that is exposed to warming rays of the sun. Numerous devices and apparatus with rake attachments or cutter blades are known for scarifying or raking ground surfaces. U.S. Pat. No. 6,634,719 to Monroe is an example of such a method. However, in many cases, such methods do not provide the desired result quickly enough since the ice is not completely removed, but merely scarred, and the sun has to perform the remaining of the work.

Another method consists in melting the ice through a chemical reaction. Chemical methods of de-icing ground surfaces include spraying a de-icing fluid or scattering de-icing crystals or solids over the ice-covered surface. One common disadvantage of these two methods is that, as the ice melts, the water flows toward low-lying areas, entraining the de-icing chemicals with it. This effectively removes the de-icing chemicals from high-lying areas. Therefore, to gain efficiency, the chemical method needs to be combined with the scarifying method, which grooves tend to retain the chemicals. A consequent drawback of this resulting method is that, when the roads have a highly curved profile and scarifying is mandatory, it requires two vehicles to perform the method. Another drawback is that some chemicals, such as salt, do not perform properly when temperatures are too cold. Furthermore, when the ice melts and water runs on the side of the road or runway, the water transporting the chemicals is absorbed by the surrounding ground, which may be detrimental to the environment.

There is therefore a need for an improved ice-removing device that is capable of effectively removing the ice from a ground surface such as a road or a runway without using spraying chemicals that are possibly hazardous to the environment.

SUMMARY OF THE INVENTION

It is an object of the present invention to provide an ice-removing device that overcomes or mitigates one or more disadvantages of known ice-removing devices, or at least provides a useful alternative.

The invention provides the advantage of removing ice from roads or runways without using chemical products that may harm the environment.

The invention also provides the advantage of removing the ice from roads or runways relatively quickly when compared to some previous methods.

In accordance with an embodiment of the present invention, there is provided an ice-removing device for removing ice from a ground surface. The ice-removing device comprises a frame and an ice cutting mechanism. The ice cutting mechanism is attached to the frame and is adapted to spin on a first axis oriented transversally to the frame. The ice cutting mechanism is operative to cut a plurality of parallel strips in the ice.

Optionally, the ice-removing device further comprises at least one ice crushing mechanism, which is also attached to the frame, behind the ice crushing mechanism. The ice crushing mechanism is adapted to spin on a second axis that is non-parallel to the first axis. Both the ice cutting mechanism and the ice crushing mechanism are operationally positioned to contact the ice.

In accordance with another embodiment of the present invention, there is provided an assembly for an ice-removing device for removing ice from a ground surface. The ice-removing device is adapted to be mounted to a mobile support. The assembly comprises an ice cutting mechanism having a first axis. The ice cutting mechanism is adapted to be transversally mounted on the mobile support. The ice cutting mechanism is operative to cut a plurality of parallel strips in the ice from the ground surface once mounted.

Optionally, the assembly comprises at least one ice crushing mechanism having a second axis on which it is adapted to spin. The ice crushing mechanism is adapted to be mounted to the mobile support behind the ice cutting mechanism so that the second axis is non-parallel to the first axis.

BRIEF DESCRIPTION OF DRAWINGS

These and other features of the present invention will become more apparent from the following description in which reference is made to the appended drawings wherein.

DETAILED DESCRIPTION OF THE INVENTION

The present invention relates to a device for removing the ice from ground surfaces such as roads or runways. The device removes the ice in two stages: in a first stage, the ice is weakened by performing a plurality of vertical cuts in it. In a second stage, strips of ice thereby created are shattered by one or many crushing mechanisms.

Figure 1:
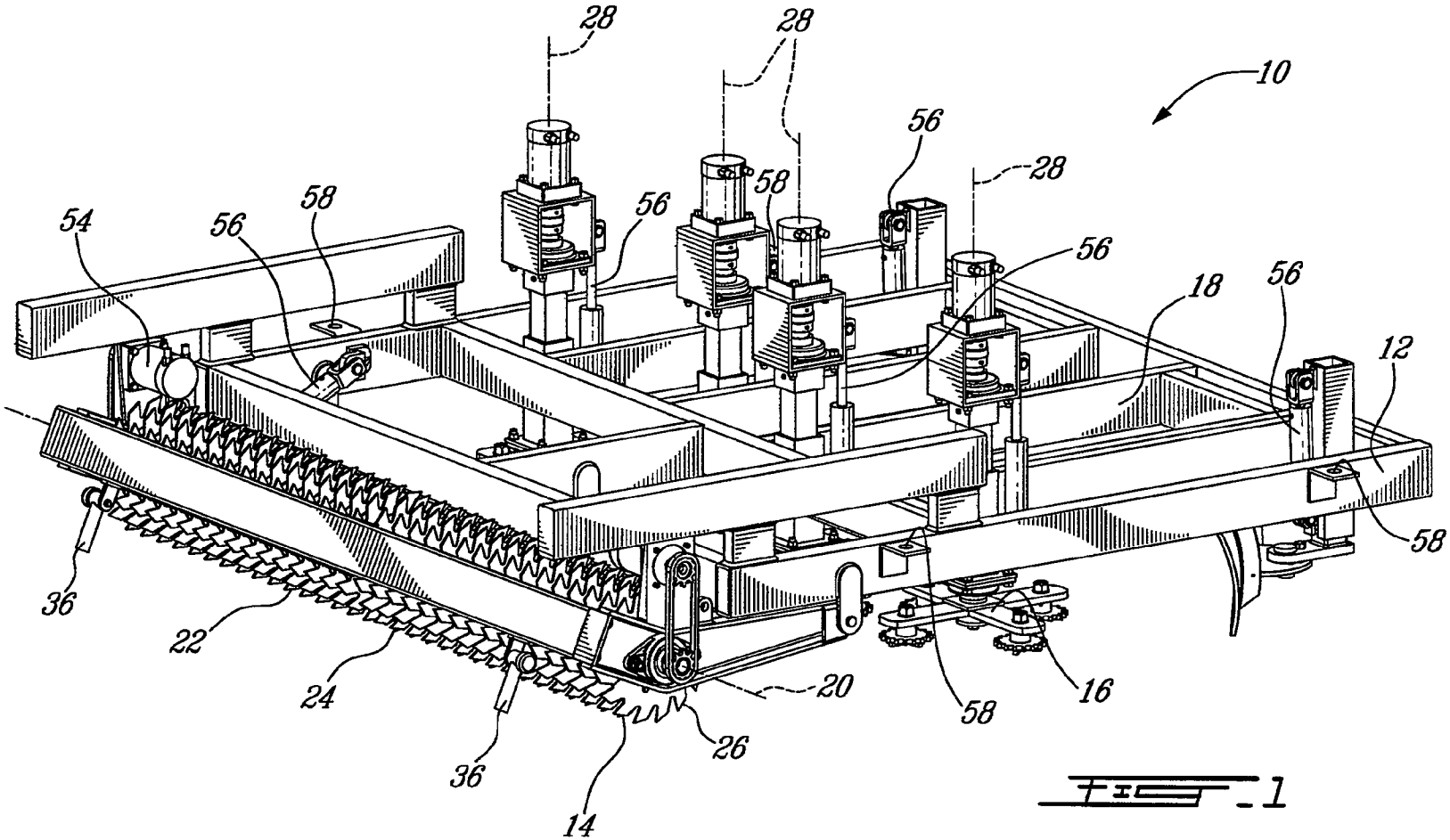
FIG. 1 is a perspective view of the ice-removing device in accordance with an embodiment of the present invention.

FIG. 1 depicts the ice-removing device 10. The ice-removing device 10 comprises a frame 12, an ice cutting mechanism 14 and an ice crushing mechanism 16. The frame 12 supports both the ice cutting mechanism 14 and the ice crushing mechanism 16. The frame is made of an assembly of tubular members 18. Different tubular members cross-sections and materials may be used. However, rectangular cross-members are used for convenience. Furthermore, since steel is both relatively heavy and relatively cheap, it is preferred for this application since more weight helps the ice-removing device 10 work against the ice. The tubular members 18 may be welded together or assembled in other conventional ways.

The ice cutting mechanism 14 spins on a first axis 20 oriented transversally to the frame 12. The ice cutting mechanism 14 is equipped with ice-cutting elements 22 such as circular blades 24. A plurality of parallel circular blades 24 are mounted on an axle 26 aligned with the first axis 20. The circular blades 24 and axle 26 spin on the first axis 20 and cut strips of ice. The circular blades 24 may be similar to circular blades used in carpentry. They may be placed at a distance between 0.5 to 6 inches from each other. The larger diameter the circular blades 24 are, the deeper the ice cutting mechanism 14 may cut the ice.

Figure 2:
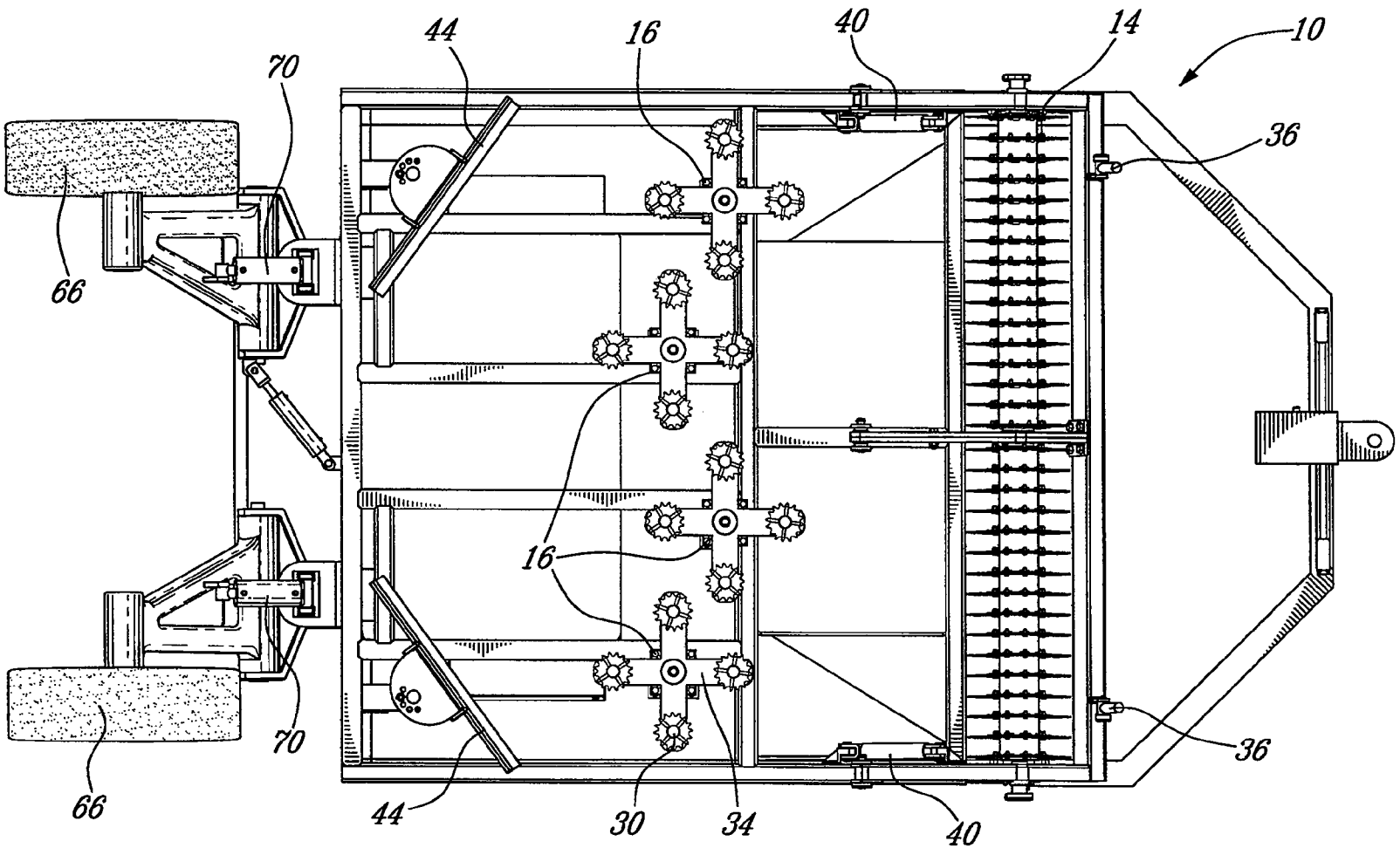
FIG. 2 is a bottom view of the ice-removing device in accordance with another embodiment of the present invention.

One or more ice crushing mechanism 16 may be used. Preferably, ice crushing mechanisms are designed such that they are not too wide, which would subject them to high stresses. Optionally, many smaller ice crushing mechanisms 16 may be placed so that ice may be shattered on most of the width of the ice-removing device 10. FIG. 2, now concurrently referred to, depicts how a plurality of ice crushing mechanisms 16 may be placed in slightly staggered rows behind the ice cutting mechanism 14 so as to cover most of the width of the ice-removing device 10. Each ice crushing mechanism 16 spins on its own second axis 28, best shown in FIG. 3, now concurrently referred to. Each second axis 28 is non-parallel to the first axis 20. Indeed, each second axis 28 is positioned vertically, or substantially vertically, so that when spinning, the ice crushing mechanisms 16 contacts the ice strips horizontally. Each ice crushing mechanism 16 comprises a plurality of spinning knives 30. Each spinning knife 30 is mounted on its own spinning axis 32. Each spinning axis 32 is parallel to its respective second axis 28, around which it itself rotates. The spinning knives 30 are mounted on a rotating arm 34 (best shown in FIG. 2). It has been found that toothed gears were very effective as spinning knives 30 since they are made of very hard heat-treated steel and have sharp teeth.

In order to ensure that both the ice cutting mechanism 14 and the ice crushing mechanism 16 are always operationally vertically positioned to contact the ice and to prevent them from coming into contact with the ground surface, a depth control system is used. The depth control system comprises a depth sensor 36 that is operative to measure a distance to the ground surface and send a depth signal to a depth controller 38. Optionally, two depth sensors 36 may be used, one on the left and one on the right side of the frame 12 so that two depth signals, one for the left depth and one for the right depth are sent to the depth controller 38. Indeed, most roads have a curved profile to drain water from its surface. It is therefore possible that the depth be different on both sides of the ice-removing device 10. If only one depth sensor 36 is used, it is preferable to place it on the longitudinal centerline of the ice-removing device 10. The depth control system further includes a first depth adjusting mechanism 40 that adjusts a depth of the ice cutting mechanism 14 with respect to the frame 12 according to the depth signals received from the depth sensors 36 via the depth controller 38. Similarly, the depth control system also comprises second depth adjusting mechanisms 42 independently controlling a depth of each ice crushing mechanism 16, each second depth adjusting mechanism 42 adjusts the depth of its corresponding ice crushing mechanism 16 with respect to the frame 12 according to the depth signals received from the depth sensors 36 via the depth controller 38. Both the first and the second depth adjusting mechanisms 40, 42 may use different types of actuation such as mechanical, electrical, hydraulic or pneumatic.

Both the ice cutting mechanism 14 and the ice crushing mechanisms 16 may be controlled to contact the ice at different depths. For example, the ice crushing mechanisms 16 may be adjusted to be closer to the ground surface than the ice cutting mechanism 14 by approximately ½ inch. Furthermore, one ice crushing mechanism 16 may be adjusted to a depth which is different from the depth of another ice crushing mechanism 16.

The ice-removing device 10 may further be equipped with one or many deflectors 44 for channeling ice removed by the ice cutting mechanism 14 and the ice crushing mechanisms 16 away from wheels of the vehicle on which the ice-removing device 10 is mounted or of its own wheels, as will be described in more details below. When so equipped, it may be convenient to further provide the ice-removing device 10 with a third depth adjusting mechanism 46 for adjusting a depth of the deflectors 44 with respect to the frame 12 according to the depth signals received from the depth sensors 36 via the depth controller 38. The third depth adjusting mechanisms 46 may also use different types of actuation such as mechanical, electrical, hydraulic or pneumatic actuation.

Optionally, each one of the ice cutting mechanism 14 and the ice crushing mechanisms 16 may further be equipped with a pressure sensor. Each pressure sensor is operative to send a pressure signal to the depth controller 38. The depth controller 38 evaluates the pressure signals from all of the pressure sensors and if the pressure value is too high, it sends an alarm signal to at least one of the first, second or third depth adjustment mechanisms 40, 42, 46 to raise towards the frame 12 at least one of the ice cutting mechanism 14, ice crushing mechanisms 16 or deflector 44.

An access to a power source is required to operate the ice-removing device 10. In an embodiment of the present invention, a power generator 48 is mounted directly on the frame 12 and the ice-removing device acts as a stand alone unit. The power generator 48 may be a gas or diesel engine, for example. The power generated by the power generator 48 may be converted in either mechanical or electrical power. Although it is not necessary, it may be more convenient to use a single type of power. For example, it is possible to use the power generator 48 to drive a hydraulic pump 50. Hydraulic pressure build up by the hydraulic pump 50 is used to power both hydraulic motors 54 and hydraulic pistons 56. Hydraulic motors 54 are used to drive the ice cutting mechanism 14 and the ice crushing mechanism 16. Hydraulic pistons 56 are used to move up and down the first, second and third depth adjusting mechanisms 40, 42, 46.

A person skilled in the art could easily envision other ways of driving the ice cutting mechanism 14 and the ice crushing mechanism 16 and to activate the depth adjusting mechanisms 40, 42, 46. Means other than hydraulic fluid, such as electricity or pneumatics for example, could be used.

Figure 4:
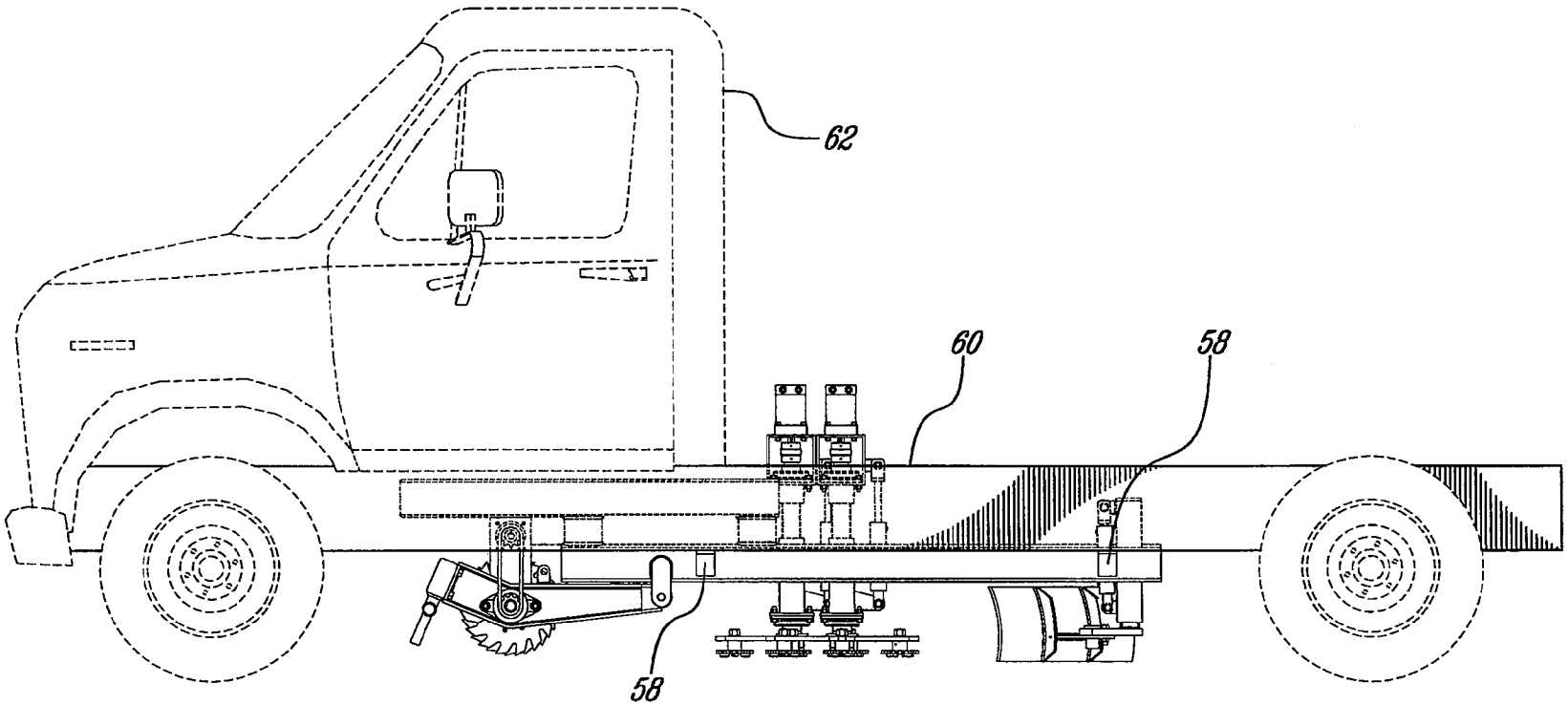
FIG. 4 is a side view of the ice-removing device of FIG. 1 attached to a vehicle.

The ice-removing device 10 may either be installed under a vehicle or be hauled behind a vehicle. The case where the ice-removing device 10 is installed under a vehicle is depicted in FIG. 4, now concurrently referred to. In this case, the frame 12 is equipped with mounting brackets 58 (best seen in FIG. 1) for fixing the ice-removing device 10 to a chassis 60 of the vehicle 62. Note that the mounting brackets 58 may be of different designs to fit different vehicles. When mounted to a vehicle like so, the ice-removing device 10 will frequently not have the power generator 48 directly mounted to its frame 12, but rather will use a power source installed in the vehicle 62. For example, a vehicle's engine could drive the hydraulic pump 50, which may be mounted remotely on the vehicle 62 and hooked to the ice-removing device 10 through hydraulic hoses.

Figure 3:
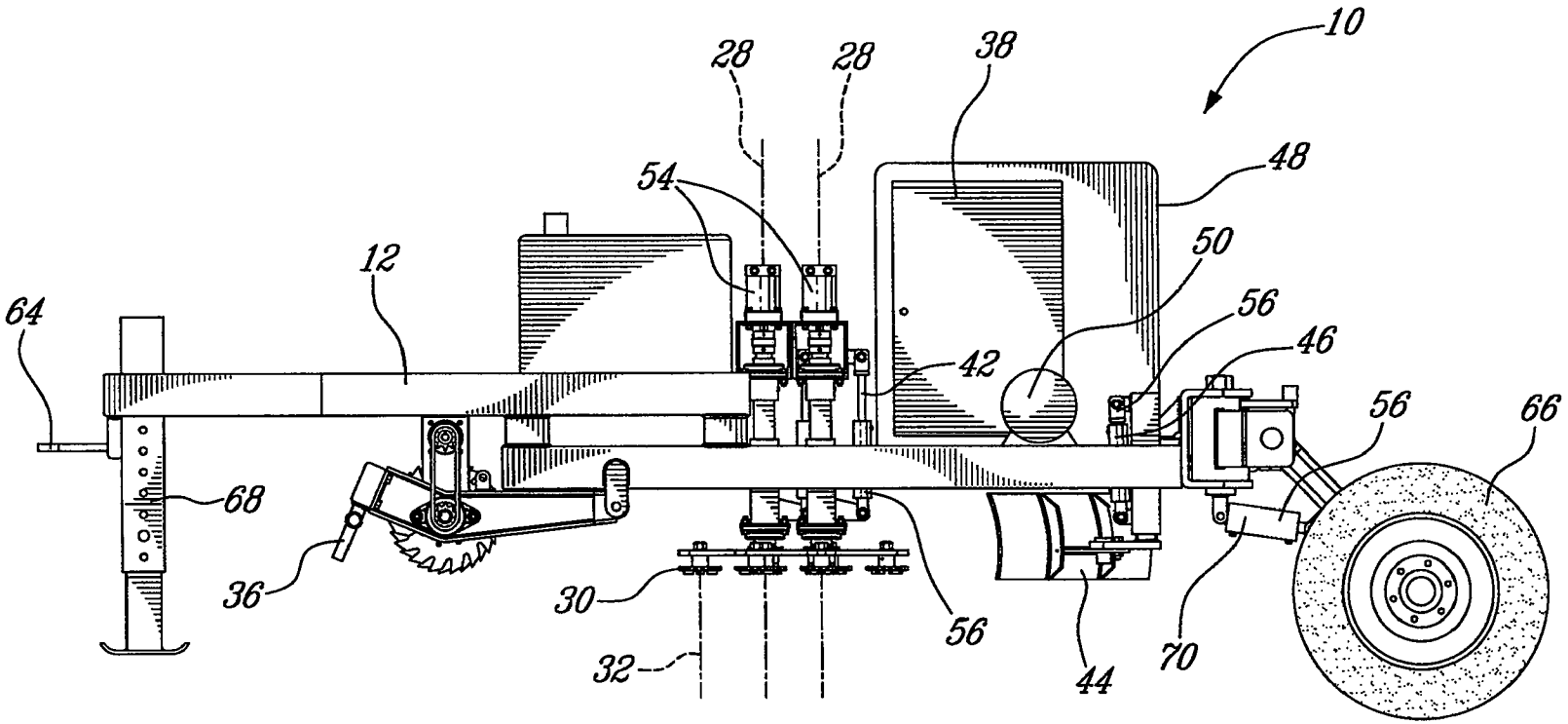
FIG. 3 is a side view of the ice-removing device of FIG. 2.
Figure 5:
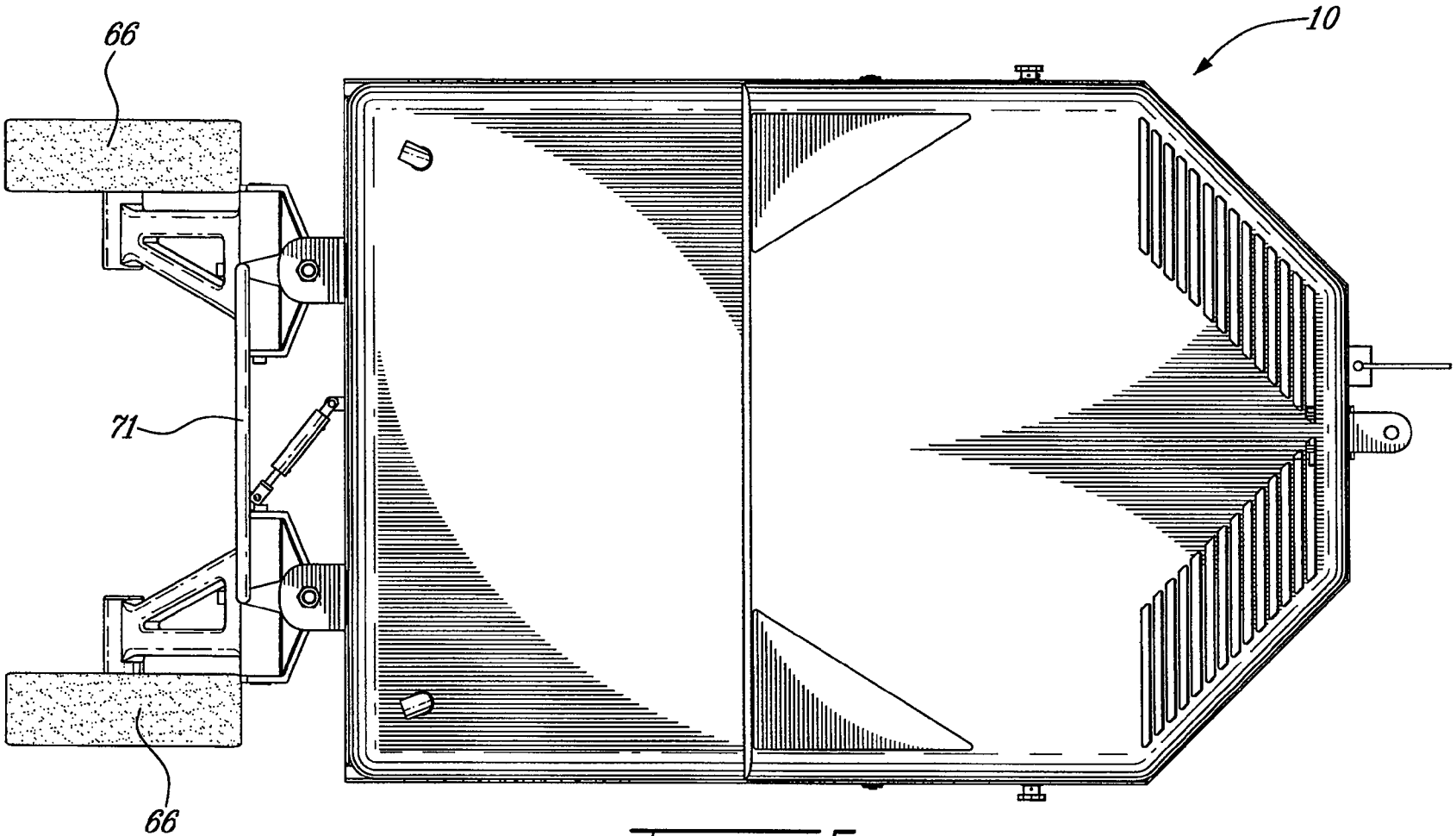
FIG. 5 is a top view of the ice-removing device comprising a steering system in accordance with another embodiment of the present invention.

The variant where the ice-removing device 10 is adapted to be hauled by a vehicle is best depicted in FIG. 3. In this case, the frame 12 extends forward and is equipped with a conventional coupler 64 that is adapted to fit a conventional hitch. In this embodiment, the frame 12 is also equipped with wheels 66 at its rear end and an extendable foot 68 at its front end for storage when the ice-removing device 10 is not attached to the vehicle. The ice-removing device 10 comprises a height adjusting mechanism 70 connected to the wheels 66. The height adjusting mechanism 70 is used to adjust the height of the frame 12 with respect to the ground according to the depth signals received from the depth sensors 36. The height adjusting mechanism 70 may independently adjust each wheel 66 so that the ice-removing device 10 may be may be best oriented to the profile of the ground surface. The height adjusting mechanism 70 may be used to coarsely adjust the height of the frame 12 with respect to the ground and then, one or many of the first, second and third depth adjusting mechanisms 40, 42, 46 are used to finely adjust one of the ice cutting mechanism 14, ice crushing mechanism 16 and deflector 44. The height adjusting mechanism 70 may use different kind of actuators such as mechanical, electrical, pneumatic or hydraulic actuators. In the present example of the invention, one hydraulic piston 56 is used. Reference is now made to FIG. 5 where the ice-removing device 10 may be steered through an optional steering system 71. The steering system 71, similar to the steering system of a car, is connected to the wheels 66 so as to steer them. The steering system 71 may be coordinated with the hauling vehicle's own steering system so that the ice-removing device 10 may precisely follow a path of the hauling vehicle.

Figure 6:
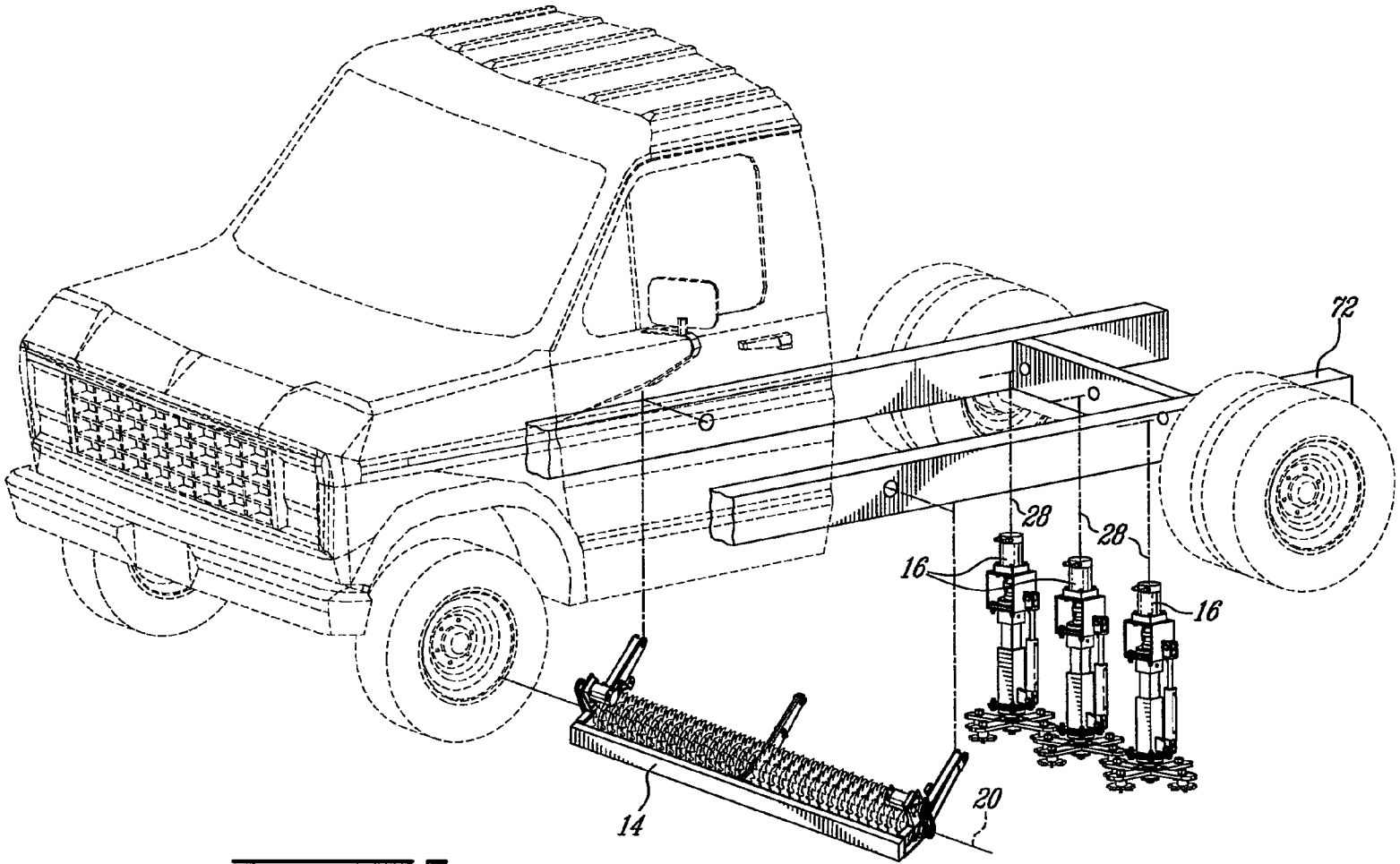
FIG. 6 is a perspective view of a kit for the assembly of an ice-removing device to a mobile support in accordance with another embodiment of the present invention.

In another embodiment of the invention, the ice-removing device may be provided as a kit ready for assembly to a mobile support, such as the vehicle 62 or the frame 12 equipped with wheels 66. This embodiment is shown in FIG. 6 where the ice cutting mechanism 14 may be provided by itself as a bolt-on unit ready to be mounted transversally on a mobile support 72. Once mounted, the ice cutting mechanism 14 is operative to cut a plurality of parallel strips in the ice from the ground surface, which, if they are narrow enough, may be sufficient to weaken adequately the ice. The kit may further include at least one ice crushing mechanism 16, which is adapted to be mounted to the mobile support 72 behind the ice cutting mechanism 14 in such a way that the second axis 28 of the ice crushing mechanism 16 is non-parallel to the first axis 20 of the ice cutting mechanism 14.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description.

I claim:

1. An ice-removing device for removing ice from a ground surface, the ice-removing device comprising:

a frame;

an ice cutting mechanism adapted to spin on a first axis, said ice cutting mechanism being attached to said frame, said first axis being oriented transversally to said frame, said ice cutting mechanism being operative to cut a plurality of parallel strips in the ice from the ground surface;

at least one ice crushing mechanism adapted to spin on a second axis, said ice crushing mechanism being attached to said frame behind said ice cutting mechanism, both said ice cutting mechanism and said ice crushing mechanism being operationally positioned to contact the ice; and a depth control system operative to measure a distance to the ground surface and accordingly adjust a distance between said ice cutting mechanism and the ground surface and independently adjust said at least one ice crushing mechanism, whereby the at least one ice crushing mechanism is adjustable to and uneven ground surface.

2. The ice-removing device of claim 1 wherein said second axis being non-parallel to said first axis.

3. The ice-removing device of claim 2 wherein said second axis is substantially vertical.

4. The ice-removing device of claim 3 wherein said ice cutting mechanism comprises a plurality of parallel circular blades adapted to spin on said first axis.

5. The ice-removing device of claim 4 wherein said ice crushing mechanism comprises a plurality of spinning knives, each spinning knife being mounted on its own spinning axis, each spinning axis being parallel to said second axis, each spinning axis rotating around said second axis of said ice crushing mechanism.

6. The ice-removing device of claim 5 comprising a plurality of said ice crushing mechanism disposed along a width of said frame.

7. The ice-removing device of claim 6 wherein said spinning knives are toothed gears.

8. The ice-removing device of claim 6 wherein said depth control system further comprise a depth sensor operative to measure said distance to the ground surface and send a depth signal.

9. The ice-removing device of claim 8 wherein said depth control system further comprises a first depth adjusting mechanism for adjusting a depth of said ice cutting mechanism with respect to said frame according to said depth signal received from said depth sensor.

10. The ice-removing device of claim 9 further comprising a plurality of second depth adjusting mechanisms, each one of said second depth adjusting mechanism being operative to adjust a depth of a corresponding one of said plurality of ice crushing mechanisms with respect to said frame.

11. The ice-removing device of claim 10 wherein said plurality of ice crushing mechanisms are configured to contact the ice closer to the ground surface than said ice cutting mechanism.

12. The ice-removing device of claim 11 wherein said frame is adapted to be installed under a vehicle.

13. The ice-removing device of claim 11 further comprising wheels for supporting said frame.

14. The ice-removing device of claim 13 further comprising a height adjusting mechanism connected to said wheels, said height adjusting mechanism being operative to adjust a height of said frame with respect to said wheels according to said depth signal received from said depth sensor.

15. The ice-removing device of claim 14 further comprising at least one deflector for directing removed ice away from said wheels.

16. The ice-removing device of claim 15 further comprising a third depth adjusting mechanism for adjusting a depth of said deflector with respect to said frame according to said depth signal received from said depth sensor.

17. The ice-removing device of claim 16 wherein said frame is adapted to be hauled by a vehicle.

18. The ice-removing device of claim 17 further comprising a power generator for providing power to said ice cutting mechanism and to said ice crushing mechanisms.

19. The ice-removing device of claim 18 wherein each one of said ice cutting mechanism and said ice crushing mechanisms are further equipped with a pressure sensor, each pressure sensor sending a pressure signal to a controller, said controller being operative to evaluate said pressure signals from all of said pressure sensors and to send an alarm signal to at least one of said first, second or third depth adjustment mechanisms to raise towards said frame at least one of said ice cutting mechanism, ice crushing mechanisms or deflector.

20. The ice-removing device of claim 14 further comprising a steering system connected to said wheels and operative to steer said wheels.

21. An assembly for an ice-removing device for removing ice from a ground surface, the ice-removing device being adapted to be mounted to a mobile support, the assembly comprising:

an ice cutting mechanism having a first axis, said ice cutting mechanism being adapted to be transversally mounted on the mobile support, said ice cutting mechanism being operative to cut a plurality of parallel strips in the ice from the ground surface;

at least one ice crushing mechanism having a second axis, said ice crushing mechanism being adapted to spin on said second axis, said ice crushing mechanism being adapted to be mounted to the mobile support; and a depth control system operative to measure a distance to the ground surface and accordingly adjust a distance between said ice cutting mechanism and the ground surface and independently adjust said at least one ice crushing mechanism, whereby the at least one ice crushing mechanism is adjustable to an uneven ground surface.

22. The assembly of claim 21 wherein said ice crushing mechanism is adapted to be mounted to the mobile support behind said ice cutting mechanism so that said second axis is non-parallel to said first axis.

23. The assembly of claim 22 wherein said second axis is adapted to be substantially vertical once mounted to the mobile support.

24. The assembly of claim 23 wherein said ice-cutting mechanism further comprises a plurality of parallel circular blades adapted to spin on said first axis.

25. The assembly of claim 24 wherein said ice crushing mechanism comprises a plurality of spinning knives, each spinning knife being mounted on its own spinning axis, each spinning axis being parallel to said second axis, each spinning axis rotating around said second axis of said ice crushing mechanism.

26. The assembly of claim 25 wherein said spinning knives are toothed gears.

* * * * *